US008384505B2

(12) United States Patent
Wu et al.

(10) Patent No.: US 8,384,505 B2
(45) Date of Patent: Feb. 26, 2013

(54) TRANSFORMER HAVING A SIMPLIFIED WINDING STRUCTURE

(75) Inventors: Li-Chun Wu, New Taipei (TW); Yong-Chun Xu, Kunshan (CN); Jian-She Hu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/209,644

(22) Filed: Aug. 15, 2011

(65) Prior Publication Data

US 2012/0038444 A1 Feb. 16, 2012

(30) Foreign Application Priority Data

Aug. 16, 2010 (CN) ..... 2010 2 0292439

(51) Int. Cl.
*H01F 27/02* (2006.01)

(52) U.S. Cl. ..... 336/90

(58) Field of Classification Search ..... 336/65, 336/83, 192, 196, 198, 200, 232, 90
See application file for complete search history.

(56) References Cited

U.S. PATENT DOCUMENTS 5,977,855 A * 11/1999 Matsumura et al. ..... 336/96
6,662,431 B1 * 12/2003 Lu et al. ..... 29/602.1
7,411,477 B2 * 8/2008 Watanabe ..... 336/192
2010/0109827 A1 5/2010 Asou et al.

FOREIGN PATENT DOCUMENTS

JP 01047006 A * 2/1989

* cited by examiner

*Primary Examiner* — Tuyen Nguyen
(74) *Attorney, Agent, or Firm* — Ming Chieh Chang; Wei Te Chung

(57) ABSTRACT

A transformer (100) includes a bar-shaped core (5), a number of coils (7) comprising a first winding group (71, 72) and a second winding group (73, 74) wound around the core, a housing (1) receiving the core and the coils, and a number of conductive terminals (3) being secured in the housing. The first winding group and the second winding group wound around different parts of the core. The coils are soldered to the conductive terminals (3). The coils (7) are wound around the core automatically by an automatic winder. Therefore, the cost of manufacturing the transformer is decreased.

11 Claims, 10 Drawing Sheets

TRANSFORMER HAVING A SIMPLIFIED WINDING STRUCTURE

BACKGROUND OF THE INVENTION

1. Field of the Invention

The present invention relates to a transformer.

2. Description of Related Art

In prior art, a transformer commonly comprise a winding frame, a first core and a second core. The winding frame has a primary winding area and a secondary winding area. The first core and the second core are set in the winding frame.

In another prior art, a transformer comprises a core, four winding wires wound together with each other around the core. U.S. Publication No. 2010/0109827 (US '827) assigned to TDK Corporation and published on May 6, 2010 discloses such a transformer. First and second terminal electrodes of the transformer are connected to each of both ends of the primary winding wire. The first terminal electrode is positioned close to the second terminal electrode. Third and fourth terminal electrodes are connected to each of both ends of the secondary winding wire. The third terminal electrode is positioned close to the fourth terminal electrode. Therefore, the core could only use low-permeability materials to avoid conduction between two close terminal electrodes. However, the low-permeability material such as nickel (Ni) is expensive. These winding structures are complex and high cost.

Hence, a transformer having a simple and low cost winding structure is desired.

BRIEF SUMMARY OF THE INVENTION

Accordingly, an object of the present invention is to provide a transformer having a simple and low cost winding structure.

In order to achieve the above-mentioned object, the present invention provides a transformer comprising a bar-shaped core; a plurality of coils comprising a first winding group and a second winding group wound around the core, the first winding group and the second winding group wound different parts of the core; a housing receiving the core and the coils; and a plurality of conductive terminals being secured in the housing, the coils being soldered to the conductive terminals. The coils are wound around the core automatically by an auto-machine. The core could use high-permeability materials being cheaper than low-permeability material such as nickel (Ni). Therefore, the cost of manufacturing the transformer is decreased.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
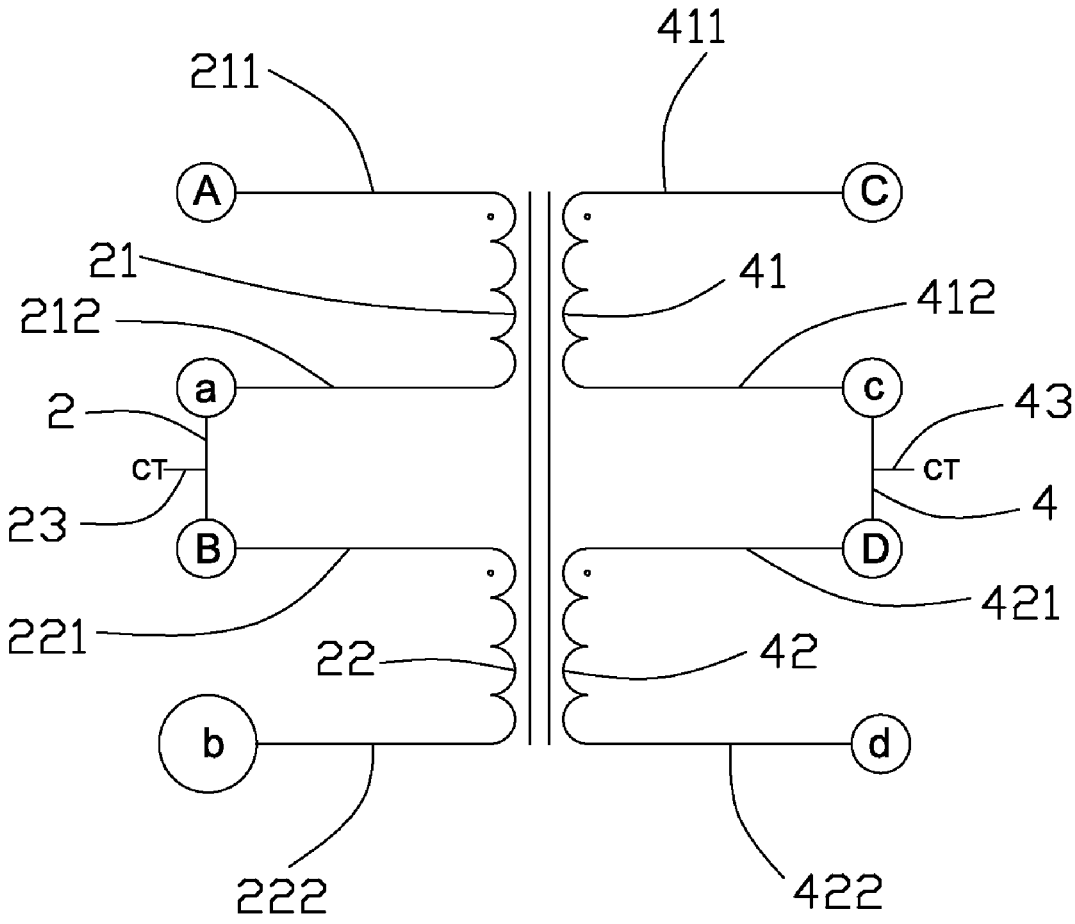
FIG. 1 shows an equivalent circuit of a transformer according to the present invention.

Reference will now be made to the drawing figures to describe the preferred embodiment of the present invention in detail. Referring to FIG. 1, the figure is a circuit diagram of a transformer 100 according to the present invention.

The transformer 100 includes a primary coil 2 and a secondary coil 4 coupled with the primary coil 2. The primary coil 2 includes a first primary coil 21 and a second primary coil 22, and the secondary coil 4 includes a first secondary coil 41 and a second secondary coil 42. The first primary coil 21 has a first tap 211 and a second tap 212. The second primary coil 22 has a third tap 221 and a fourth tap 222. The first secondary coil 41 has a fifth tap 411 and a sixth tap 412. The second secondary coil 42 has a seventh tap 421 and an eighth tap 422. The second tap 212 connects with the third tap 221 to form a first tap 23. The sixth tap 412 connects with the seventh tap 421 to form a second tap 43. The first tap 23 and the second tap 43 ground for filtering out the noise in signal transmission.

Referring to FIGS. 2-5, according to the first illustrated embodiment of the present invention, the transformer 100 includes a bar-shaped core 5, a plurality of coils 7 wound around the core 5, a housing 1 receiving the core 5 and the coils 7, a plurality of conductive terminals 3 being secured in the housing 1, a lid 8 covering the core 5 and the coils 7, and a gel 9 enclosing the core 5 and the coils 7.

The housing 1 is a hollow rectangle and includes a pair of first sidewalls 11, a pair of second sidewalls 13, and a lower wall 111 cooperating with each other to define a recess 15 for receiving the core 5 and the coils 7. The lower wall 111 connects with the first sidewalls 11 and the second sidewalls 13. The terminals 3 are insert molded in the pair of first sidewalls 11. Each of the terminals 3 has a first pad portion 31 exposed to the first sidewalls 11 and a second pad portion 32 extending outwardly from the lower wall 111. The first pad portion 31 is disposed in the recess 15. The second pad portion 32 is substantially flush with the lower wall 111 of the housing 1 and surface soldered to an outer device (not shown).

The core 5 is arranged as I-shaped and has a cylindrical body 51 and two blocking portions 52 disposed at the two distal ends of the body 51. The body 51 is not limited to be formed into a cylindrical body 51 but also could be formed into rectangle or other shapes.

The coils 7 include a first winding group 71, 72 and a second winding group 73, 74 wound around different parts the core. The first winding group 71, 72 includes a first coil 71 and a second coil 72. The second winding group 73, 74 includes a third coil 73 and a fourth coil 74. In the first illustrated embodiment, the first winding group 71, 72 is wound from near one blocking portion 52 to the central region of the core 5 in a first direction. The second winding group 73, 74 is wound from the central region of the core 5 to near the other blocking portion 52 in the first direction. The first winding group 71, 72 is separated from the second winding group 73, 74 at the central region of the core 5. The first winding group 71, 72 and the second winding group 73, 74 are soldered to the first pad portions 31.

Figure 2:
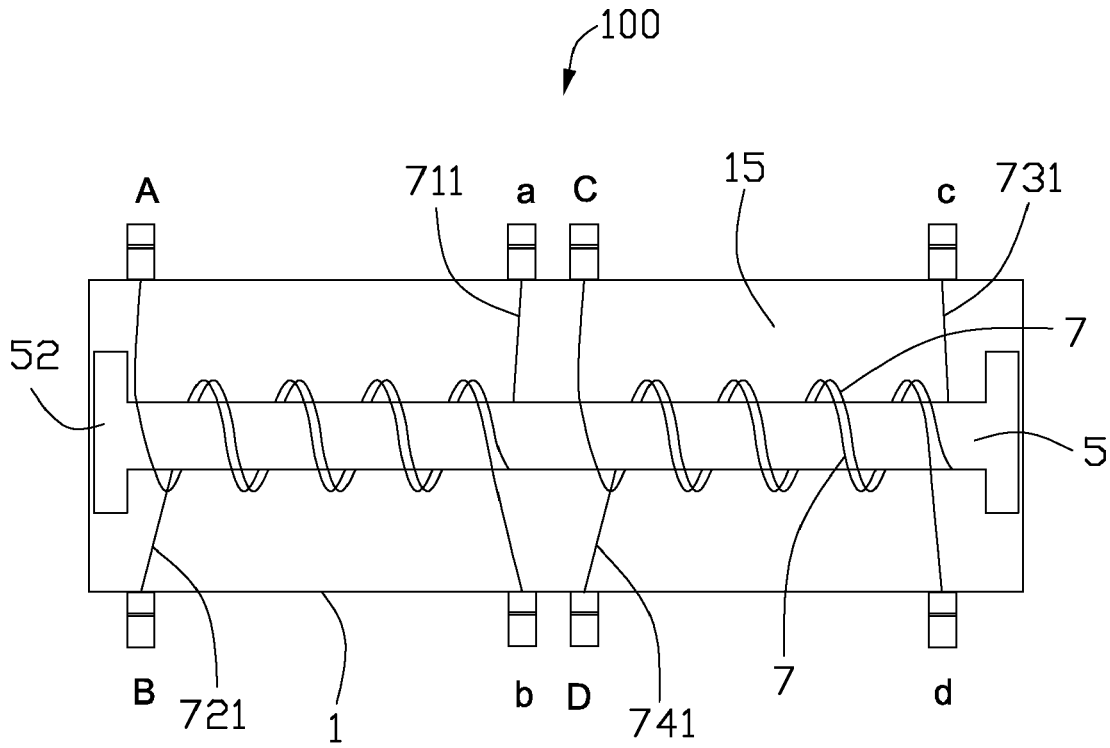
FIG. 2 is a schematic diagram of the transformer according to a first embodiment, with a lid thereof being removed.
Figure 3:
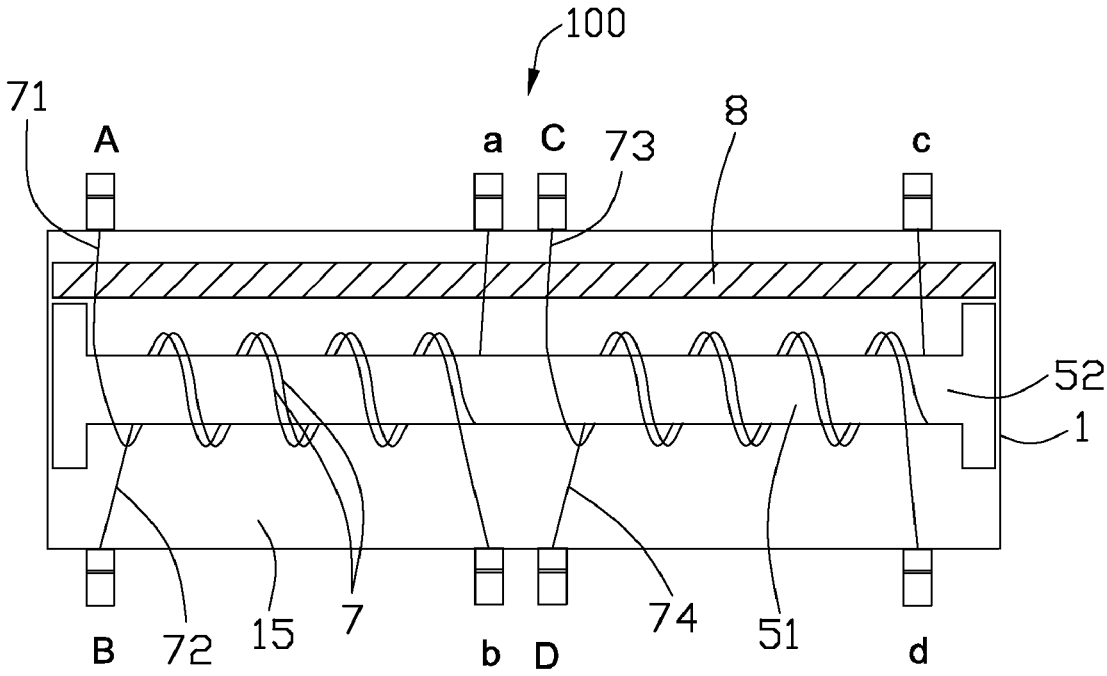
FIG. 3 is a schematic diagram of the transformer shown in FIG. 2.
Figure 4:
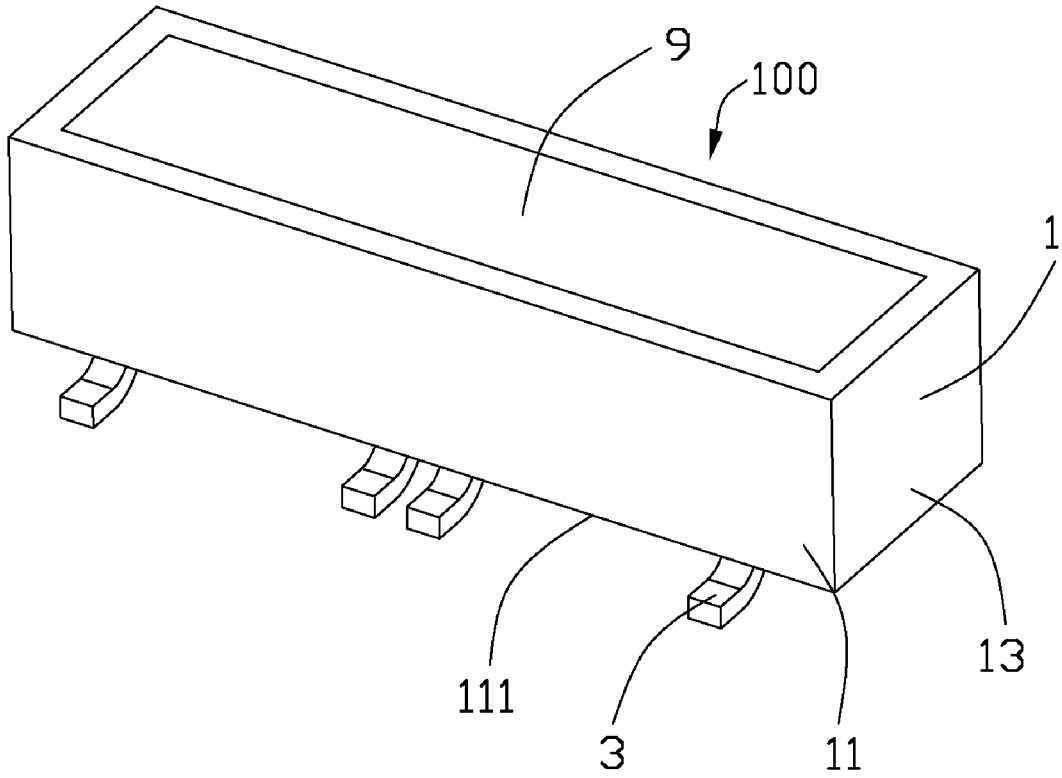
FIG. 4 is a perspective view of the transformer as shown in FIG. 3.
Figure 5:
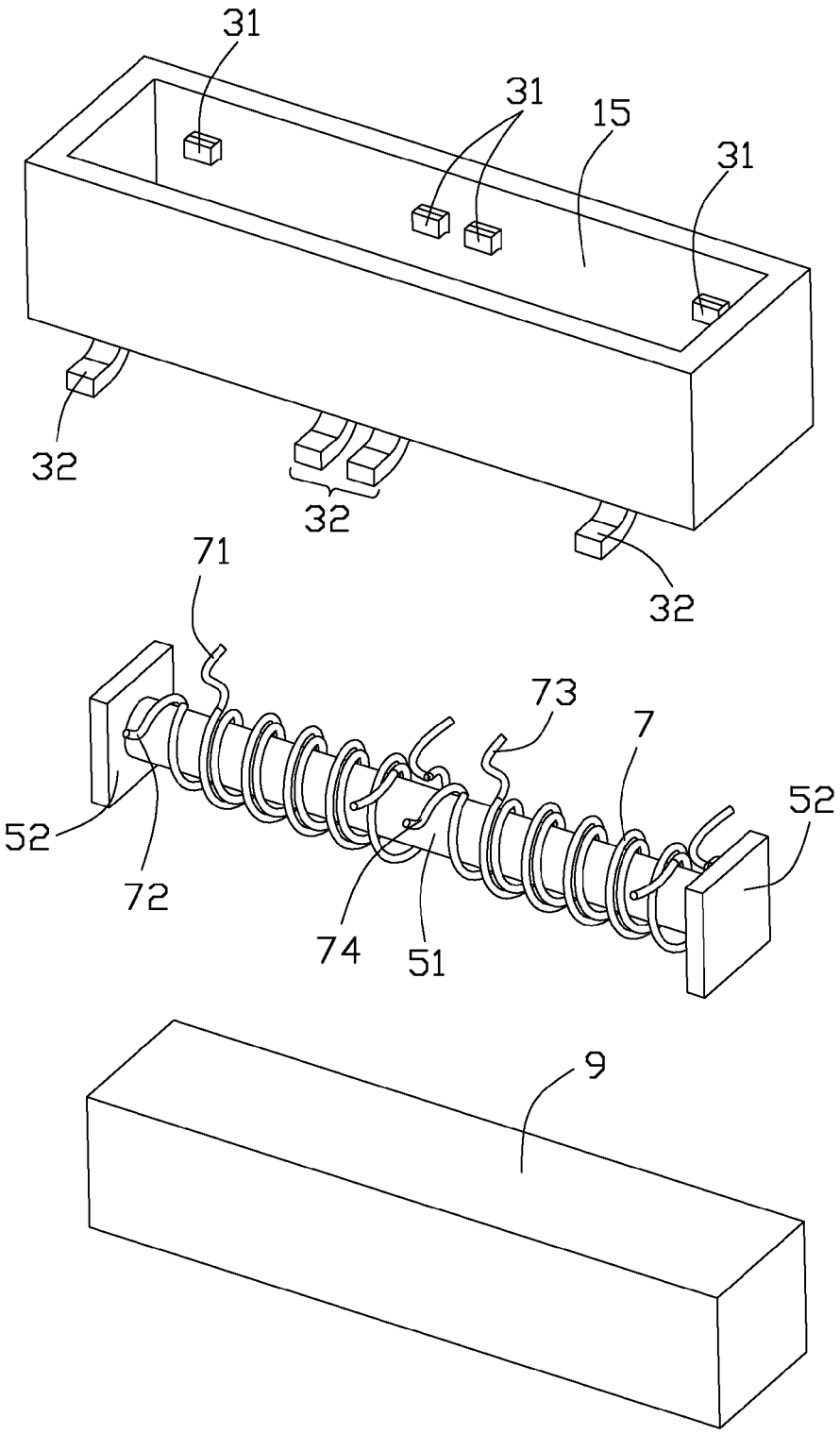
FIG. 5 is an exploded view of the transformer as shown in FIG. 4.

Referring to FIGS. 1-2, the first coil 71 is electrically connected with the second coil 73 to form the primary coil 2, and the third coil 73 is electrically connected with the fourth coil 74 to form the secondary coil 4. The first coil 71 has a first tap 711 disposed at the central region of the core 5, and the second coil 72 has a second tap 721 disposed near one blocking portion 52. The third coil 73 has a third tap 731 disposed at the other blocking portion 52, and the fourth coil 74 has a fourth tap 741 disposed at the central region of the core 5. The first tap 711 (*a*) electrically connects to the second tap 721 (B) for grounding through the outer device (not shown). The third tap 731 (*c*) electrically connects to the fourth tap 741 (D) for grounding through the outer device (not shown).

The lid 8 covers the core 5 and the coils 7 for improving the electrical properties of the transformer 100.

Figure 6:
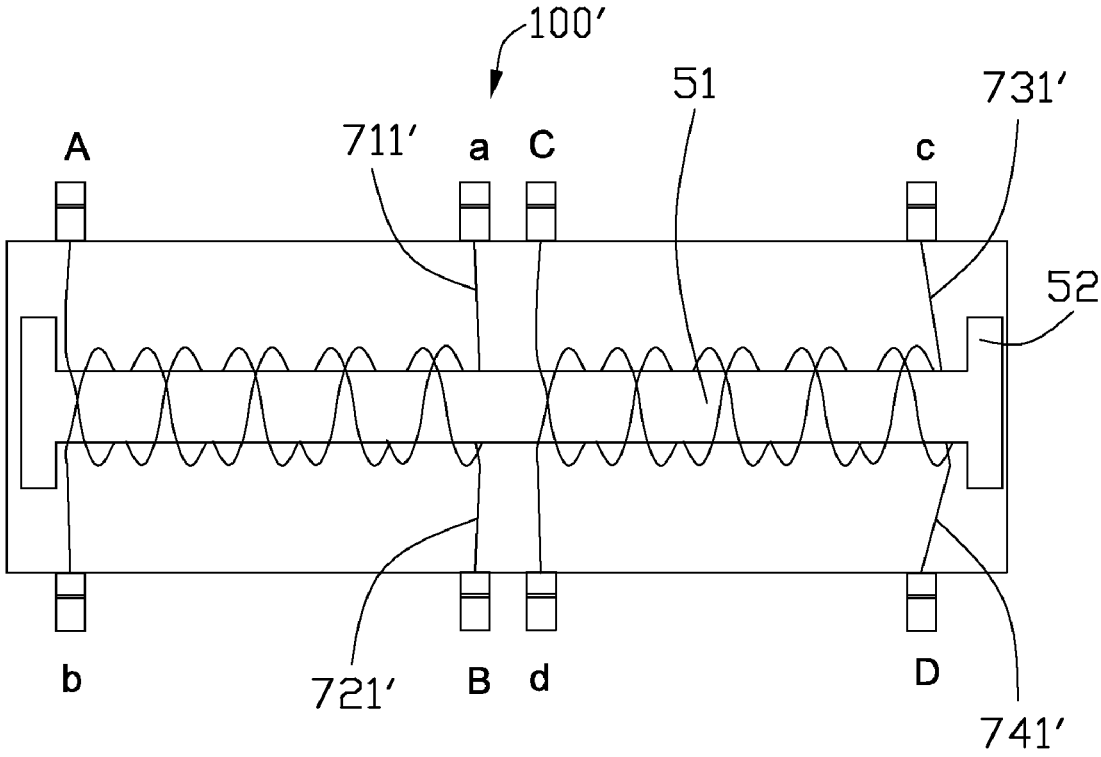
FIG. 6 is a schematic diagram of the transformer according to a second embodiment, with a lid thereof being removed.
Figure 7:
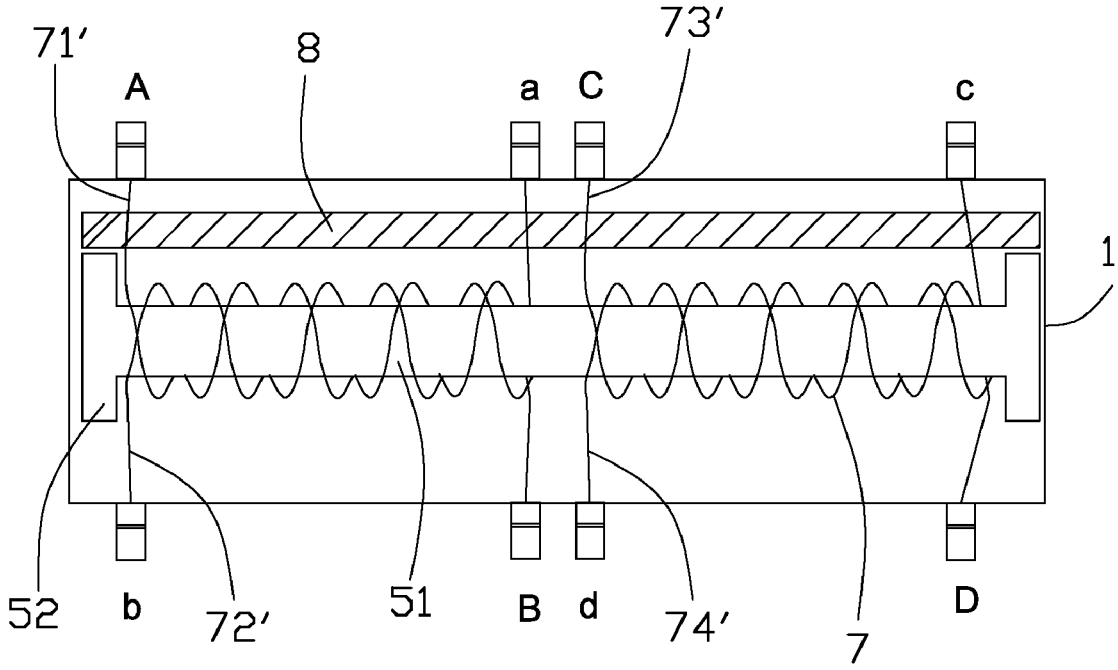
FIG. 7 is a schematic diagram of the transformer shown in FIG. 6.
Figure 8:
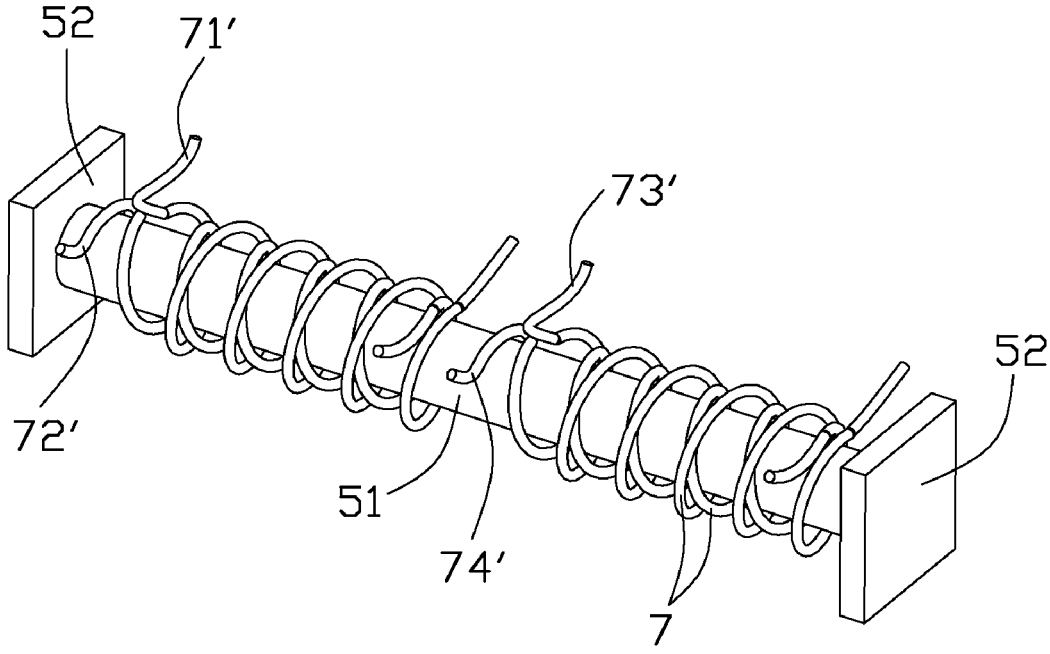
FIG. 8 is a perspective view of the core and the coils as shown in FIG. 6.

Referring to FIGS. 6-8, according to the second illustrated embodiment of the present invention, a transformer 100' includes a winding group 71', 72' being wound from near one blocking portion 52 to the central region of the core 5 and a second winding group 73', 74' being wound from the central region of the core 5 to near the other blocking portion 52, which are totally same as defined in the first illustrated embodiment. The difference between the second and the first illustrated embodiment is the winding direction.

In the second illustrated embodiment, the first coil 71' and the third coil 73' are wound in a first direction around the core 5. The second coil 72' and a fourth coil 74' are wound in a second direction opposite to the first direction around the core 5.

Referring to FIG. 1 and FIG. 6, the first coil 71' is electrically connected with the second coil 72' to form the primary coil 2, and the third coil 73' is electrically connected with the fourth coil 74' to form the secondary coil 4. The first coil 71' and the second coil 72' have two taps 711' (a), 721' (B) respectively disposed at the central region of the coil 5 for electrical connection and grounding purpose. The third coil 73' and the fourth coil 74' have two taps 731' (c), 741' (D) respectively disposed near one blocking portion 52 for electrical connection and grounding purpose.

Figure 9:
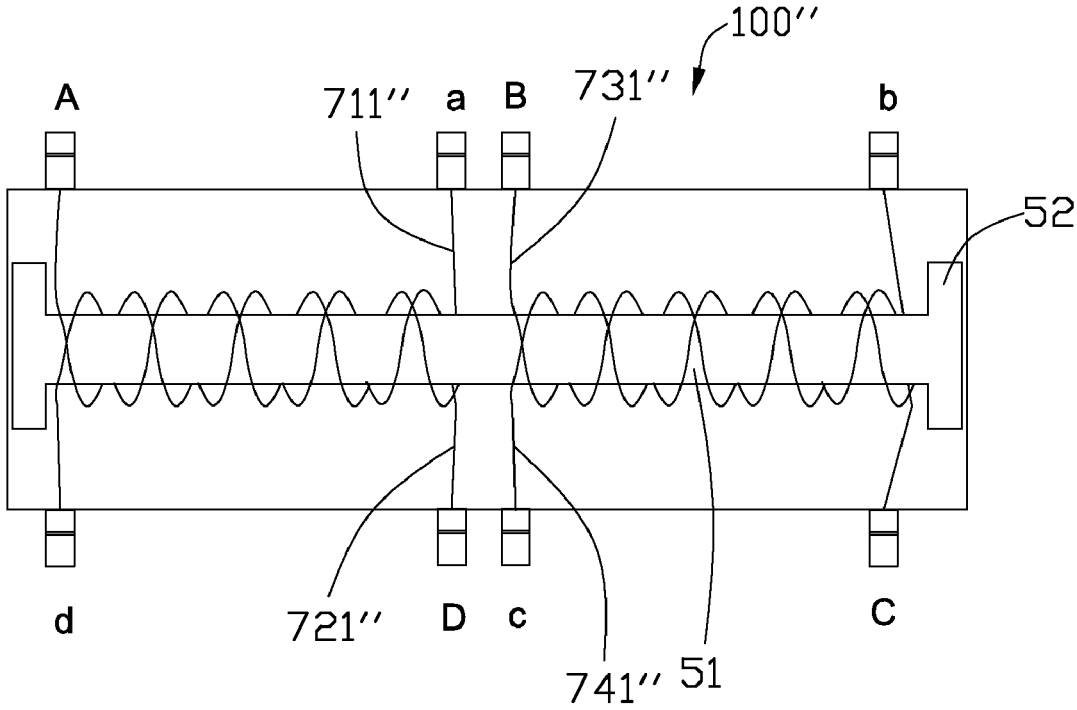
FIG. 9 is a schematic diagram of the transformer according to a third embodiment, with a lid thereof being removed.
Figure 10:
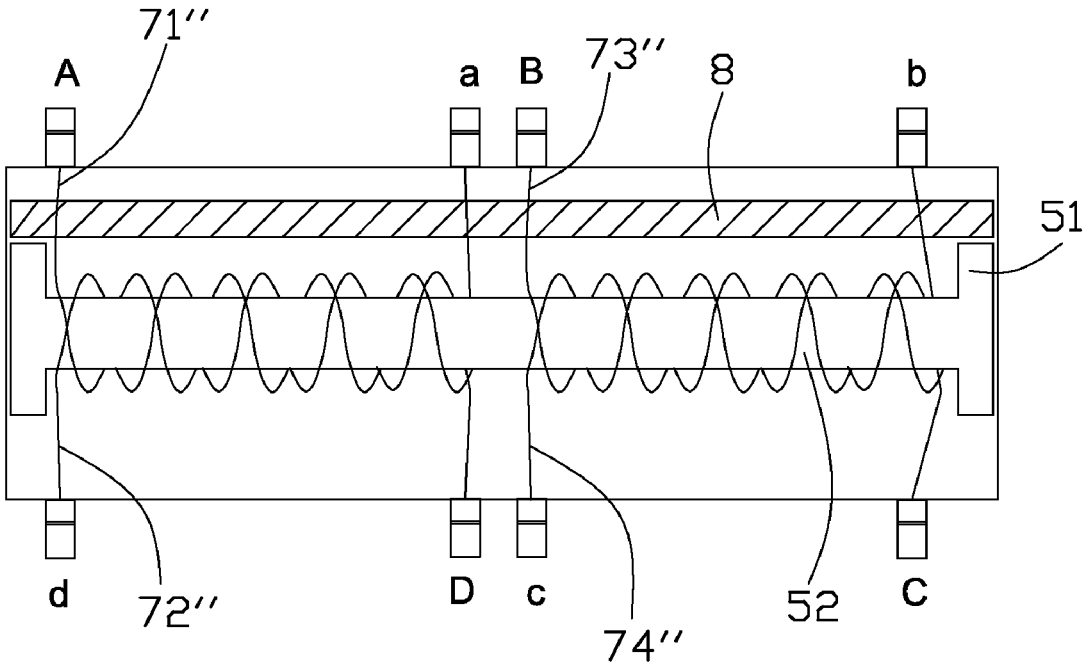
FIG. 10 is a schematic diagram of the transformer shown in FIG. 9.

Referring to FIGS. 9-10, according to the third illustrated embodiment of the present invention, the winding way and structure of the coils 71", 72", 73", 74" are totally same as the second illustrated embodiment. The difference between the third and second illustrated embodiment is the primary coil 2 and the secondary coil 4 formed with different coils.

Referring to FIG. 1 and FIG. 9, the first coil 71" is electrically connected with the third coil 73" to form the primary coil 2, and the second coil 72" is electrically connected with the fourth coil 74" to form the secondary coil 4. The first coil 71" and the third coil 73" have two taps 711" (a), 731" (B) disposed at the central region of the core 5 for electrical connection and grounding purpose. The second coil 72" and the fourth coil 74" has two taps 721" (D), 741" (c) disposed at the central region of the coil 5 for electrical connection and grounding purpose.

According to the above description, the two ends of primary coil 2 separate far away from each other, and the two ends of secondary coil 4 separate far away from each other. Compared with above-mentioned US '827 TDK publication, the core could use high-permeability materials such as manganese (Mn) due to the far distance. Mn is cheaper than Ni, and the coils (7) are wound around the core automatically by an automatic winder. Therefore, the cost of manufacturing the transformer is decreased.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A transformer comprising:

a bar-shaped core defining first and second sections along an axial direction thereof without overlapping therebetween;

a first pair of coils wound around the first section and each having a respective pair of opposite end regions, the pair of opposite end regions of one coil being located at one side of the first section and the pair of opposite end regions of the other coil being located at the other side of the first section in a transverse opposite manner;

a second pair of coils wound around the second section and each having a respective pair of opposite end areas, the pair of opposite end areas of one coil being located at one side of the second section and the pair of opposite end areas of the other coil being located at the other side of the second section in a transverse opposite manner;

a housing receiving the core and the coils, the housing comprising a pair of sidewalls and a lower wall connecting with the sidewalls; and a plurality of conductive terminals being secured in the housing, each terminal having a first pad portion exposed from a corresponding sidewall, a second pad portion extending outwardly from the lower wall, and a third portion buried in the corresponding sidewall;

wherein the first and second pair of coils are physically and electrically connected to the first pad portions to form primary and secondary coils.

2. The transformer as claimed in claim 1, wherein the core is arranged as I-shaped, and each sidewall is insert molded with four terminals, two of the four terminals disposed at two opposite end sections of the sidewall and the other two terminals disposed at a middle section of the sidewall.

3. The transformer as claimed in claim 1, wherein the sidewalls and the lower wall form a receiving space, the first pad portions extending into the receiving space from the sidewalls, the second pad portions being coplanar and surface soldered to an outer device.

4. The transformer as claimed in claim 3, wherein the first pair of coils comprise a first coil and a second coil, the second pair of coils comprising a third coil and a fourth coil.

5. The transformer as claimed in claim 4, wherein the first coil and the second coil are wound in a same direction around the core, and the third coil and the fourth coil are wound in a same direction around the core.

6. The transformer as claimed in claim 5, wherein the first coil is electrically connected with the second coil to form the primary coil, and the third coil is electrically connected with the fourth coil to form the secondary coil.

7. The transformer as claimed in claim 4, wherein the first coil and the third coil are wound in a first direction around the core, and the second coil and the fourth coil are wound in a second direction opposite to the first direction around the core.

8. The transformer as claimed in claim 7, wherein the first coil is electrically connected with the second coil to form a primary coil, and the third coil is electrically connected with the fourth coil to form a secondary coil.

9. The transformer as claimed in claim 7, wherein the first coil is electrically connected with the third coil to form a primary coil, and the second coil is electrically connected with the fourth coil to form a secondary coil.

10. The transformer as claimed in claim 1, further comprising a gel enclosing the core and the coils.

11. The transformer as claimed in claim 1, further comprising a lid covering the core and the coils.

* * * * *